US005237115A

United States Patent [19]

Makovec et al.

[11] Patent Number: 5,237,115

[45] Date of Patent: Aug. 17, 1993

[54] INTEGRATED OLEFIN PROCESSING

[75] Inventors: Donald J. Makovec; Robert O. Dunn; Martyn E. Pfile; Gary R. Patton; Larry E. Lew, all of Bartlesville, Okla.

[73] Assignee: Phillips Petroleum Company, Bartlesville, Okla.

[21] Appl. No.: 899,820

[22] Filed: Jun. 16, 1992

Related U.S. Application Data

[63] Continuation of Ser. No. 670,086, Mar. 15, 1991, abandoned.

[51] Int. Cl.[5] ..... C07C 2/00

[52] U.S. Cl. ..... 585/314; 585/310; 585/324; 585/331; 568/697

[58] Field of Search ..... 585/304, 314, 323, 331, 585/332, 654, 253, 258, 259

[56] References Cited

U.S. PATENT DOCUMENTS 3,113,983 10/1963 Kinsch et al. ..... 260/677
5,023,389 6/1991 Grandvallet et al. ..... 585/304
5,057,635 10/1991 Gajda ..... 585/259

*Primary Examiner*—Asok Pal
*Assistant Examiner*—P. Achutamurthy
*Attorney, Agent, or Firm*—Charles W. Stewart

[57] ABSTRACT

A novel integrated olefin processing scheme is provided where olefins and paraffins are processed to produce high octane gasoline blending components. The integrated process involves the dehydrogenation of paraffin compounds to olefin compounds and the processing of olefins by hydroisomerization to produce hydroisomerate streams which are subsequently etherified. Those olefin compounds which are not etherified pass to an alkylation process where they are alkylated with branched chain paraffin compounds to produce an alkylate product.

17 Claims, 2 Drawing Sheets

INTEGRATED OLEFIN PROCESSING

This is a continuation of copending application Ser. No. 07/670,086 filed Mar. 15, 1991 now abandoned.

This invention relates to a process for producing gasoline blending components. More specifically, this invention relates to the processing of paraffin hydrocarbons and olefin hydrocarbons in an integrated system to produce gasoline blending components.

Recent governmental regulations enacted in response to the 1990 Clean Air Act have resulted in the requirement that motor gasoline be reformulated to include greater concentration levels of oxygenate compounds and lower aromatic concentrations. These new regulations, by reducing the allowable aromatics concentration which is permissible in motor fuel, will also result in removing octane from the gasoline pool resulting in a reduction in gasoline pool volume or octane, or both. Furthermore, the governmental regulations requiring a reduction in permissible gasoline vapor pressure will result in the creation of a supply of normal butane that must be removed from the gasoline pool and also possibly reducing the available gasoline pool octane.

In responding to these new governmental regulations, a number of processes have been developed which can be used to process olefin compounds to produce high octane gasoline blending components. One of these processes includes an integrated system having a dehydrogenation process which is utilized to dehydrogenate hydrocarbons to their corresponding olefin compounds. Furthermore, various olefin compounds produced by catalytic cracking processes are utilized as a feedstock to the integrated system in order to produce high octane alkylate and high octane oxygenate compounds. This integrated olefin processing scheme can effectively be used to produce high octane gasoline blending components which replace much of the octane loss resulting from the removal of aromatics from the gasoline pool. Additionally, these gasoline blending components can help to provide oxygenate levels which are required by various newly promulgated government regulations. While the integration system can be effective in producing desirable gasoline blending components, there are some problems from the use of the subprocesses of the integrated system which need to be resolved in order to have an effective process. For instance, in the dehydrogenation of paraffin compounds to olefin compounds, there results the undesirable production of small quantities of diolefin compounds. Furthermore, in the catalytic cracking of heavy hydrocarbons to shorter chain hydrocarbons and olefin compounds, there is also the production of various undesirable diolefin compounds. These diolefin compounds have been found to have negative consequences in certain downstream alkylation processes causing increases in the operating costs of such processes.

It is therefore an object of this invention to provide an integrated olefin process which can be utilized to produce gasoline blending components.

It is another object of this invention to provide an integrated olefin process which reduces the operating costs associated with the produced gasoline blending components.

Yet another object of this invention is to provide an integrated olefin process which can produce gasoline blending components that provide oxygen compounds for the gasoline pool and which utilizes excess paraffin hydrocarbon feed stocks by converting such feed stocks to final gasoline blending components.

The process of this invention includes the dehydrogenation of paraffin hydrocarbons to produce a dehydrogenate stream comprising olefin compounds. Additionally, a cracked hydrocarbon stream which comprises olefin compounds is separated to produce a $C_4$ olefin stream and a $C_5$ olefin stream. The $C_4$ olefin stream combines with the dehydrogenate stream and the two streams are further processed by hydroisomerizing the combined stream to produce a first hydroisomerate stream. The $C_5$ olefin stream is processed by hydroisomerization to produce a second hydroisomerate stream. The isomerate streams can undergo etherification whereby selected olefin compounds are reacted to produce oxygenate compounds. The unreacted compounds from the etherification process undergo an alkylation step whereby they are alkylated by a branched chain hydrocarbon to produce an alkylate stream.

Other objects, aspects and features of the present invention will be evident from the following detailed description of the invention, the claims and the drawings in which:

Figure 1:
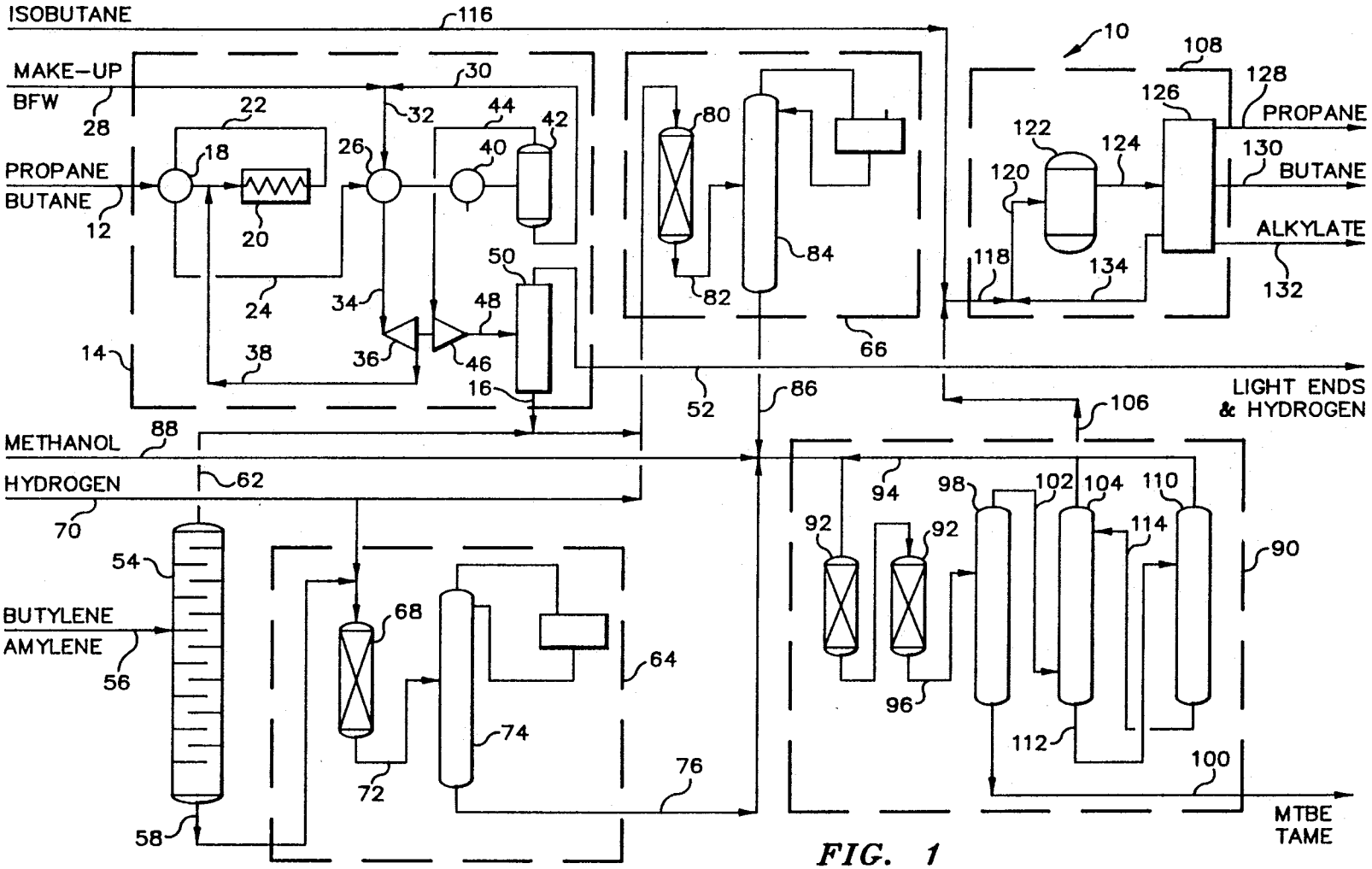
FIG. 1 is a schematic process flow diagram illustrating one preferred embodiment of the invention having parallel hydroisomerization processing and co-etherification processing of olefins.

The process of this invention utilizes an integrated process for processing and treating olefin hydrocarbon streams and for dehydrogenating paraffin hydrocarbons to produce the corresponding olefin hydrocarbons which also are subsequently processed and treated. The olefin compounds charged to the inventive process system or produced by the inventive process system undergo hydroisomerization followed by etherification and, for those olefin compounds unreacted in the etherification process, alkylation.

In accordance with the instant inventive integrated process, a subprocess is provided for dehydrogenating a dehydrogenatable hydrocarbon feed using a bed of steam active dehydrogenation catalyst which is repetitively regenerated with steam and oxygen-containing gas wherein the flow rate of steam through the catalyst bed is maintained constant. More specifically, the dehydrogenation subprocess involves passing dehydrogenatable hydrocarbon feed through the catalyst bed under dehydrogenation conditions for a period of time, then stopping the flow of dehydrogenatable hydrocarbon to the catalyst bed, then after the steam has purged at least part of the dehydrogenatable hydrocarbon from the catalyst bed passing oxygen-containing gas through the catalyst bed under regeneration conditions for a period of time, then stopping the flow of oxygen-containing gas to the catalyst bed, then after the steam has purged at least part of the oxygen from the catalyst bed passing dehydrogenatable hydrocarbon through the catalyst bed under dehydrogenation conditions.

The dehydrogenation subprocess can be any dehydrogenation process which employs a steam active dehydrogenation catalyst. This dehydrogenation subprocess is particularly suitable for use when the steam active dehydrogenation catalyst comprises (1) a support selected from the group consisting of alumina, silica, magnesia, zirconia, alumina-silicates, Group II aluminate spinels and mixtures thereof and (2) a catalytic amount of at least one Group VIII metal. (Groups of metals as referred to herein are the groups of metals as classified in the Periodic Table of the Elements as set forth in Chemical Rubber Company's "Handbook of Chemistry and Physics", 45th Edition (1964), page B-2).

Any catalytically active amount of Group VIII metal can be employed in the steam active dehydrogenation catalysts. Generally the Group VIII metal is present in the catalyst in an amount in the range of about 0.01 to about 10 weight percent of the weight of the support, more often about 0.1 to about 5 weight percent.

Other suitable copromoter metals can also be employed in the steam active dehydrogenation catalyst in conjunction with the Group VIII metal. A preferred type of such co-promoters are Group IVa metals selected from the group of lead, tin, and germanium. The Group IVa metal can exist in the range of about 0.01–10 weight percent of said support, and in one embodiment, can exist in the range of about 0.1–1 weight percent of said support, and in one further embodiment, can exist in the range of about 0.1–0.5 weight percent of said support. Although any Group IVa metal, when in compound form, is fully within the scope of this invention, some convenient compounds are the halides, nitrates, oxalates, acetates, carbonates, propionates, tartrates, bromates, chlorates, oxides, hydroxides, and the like of tin, germanium and lead. Tin, itself, is the preferred Group IVa metal and impregnation of the support with tin compounds such as the stannous halides is particularly effective and convenient.

Generally speaking, the Group VIII and Group IVa compounds, which can be combined with the supports to form the catalysts used in the dehydrogenation process can be any compound in which all elements, other than those of Group VIII, or Group IVa, are volatilized during calcination. These compounds can be sequentially combined with the support, in any order, or for convenience, can be applied simultaneously in a single impregnation operation. After impregnation, the composite solids are dried and calcined.

The dehydrogenation subprocess is conducted under any suitable operating conditions. Generally, the dehydrogenation is carried out such that the temperature in the inlet portion of the catalyst beds is at a temperature in the range of about 900° F. to about 1,150° F., preferably about 950° F. to about 1,020° F. The dehydrogenation is also conducted at a pressure in the range of about 0 to about 200 psig, preferably about 0 to about 100 psig. Generally, the molar ratio of steam to hydrocarbon is in the range of about 1/1 to about 25/1, preferably about 2/1 to 10/1. The use of an externally heated reactor, i.e., a reactor within a fired furnace, enables one to carry out the present invention with the lower levels of steam. The liquid hourly space velocity of hydrocarbon, i.e., volume of hydrocarbon per volume of catalyst per hour, is generally in the range of about 0.5 to about 10, preferably about 2.0 to about 6.

The regeneration steps can also be conducted under any suitable conditions. Generally the temperature and pressure of the catalyst bed is as in the dehydrogenation step. Oxygen is employed in the steam in an amount in the range of about 0.5 to about 5.0 mole percent, or higher, of the moles of steam.

The hydrocarbon feed can be any dehydrogenatable hydrocarbon. The process is particularly suitable for hydrocarbons having from 3 to 8 carbon atoms per molecule. Preferably, the dehydrogenatable hydrocarbons are saturated hydrocarbons and, most preferably, they are either propane or butanes, or pentanes or mixtures of any two or more thereof.

It has also been found desirable to include nitrogen in the steam during the purging steps that are employed between dehydrogenation and regeneration. Any amount of nitrogen can be employed that will assist in the purging of material from the catalyst bed.

The present invention is particularly well adapted for use in a dehydrogenation subprocess which uses more than one catalyst bed. When more than one catalyst bed is employed, it is possible to carry on dehydrogenation in one bed while regeneration is being conducted in another, thus minimizing or eliminating the interruption of hydrocarbon feed conversion. The flows of hydrocarbon feed and steam need not be interrupted but instead only diverted. The flow rate of hydrocarbons feed and steam allows for the respective preheaters to operate under a constant load, which is more efficient in terms of energy usage. Using more than one catalyst bed also enables one to make more efficient use of the steam because one can use the effluent from a bed that is being regenerated to indirectly heat the hydrocarbon feed that is being supplied to a bed where dehydrogenation is being carried out. It is also possible to use the effluent from the catalyst beds to indirectly heat water to produce additional low pressure steam for use in the process.

The feed streams which are hydroisomerized according to this invention comprise terminal acyclic olefins having from 3 to about 6 carbon atoms per molecule. Substantially pure streams of butene-1, pentene-1, hexene-1, and the like, can be employed if desired. However, the dehydrogenate stream which is charged to one hydroisomerization process will usually contain small amounts of diolefins, propylenes and butylenes. The cracked hydrocarbon stream, which is separated into two or more streams that are subsequently hydroisomerized according to this invention, comprises mixtures of hydrocarbons which contain (a) at least one acyclic terminal monoolefin having from 4 to about 7 carbon atoms per molecule, optionally (b) at least one acyclic internal monoolefin having the same number of carbon atoms as (a), and (c) at least one skeletal isomer of (a) and (b). The term "hydroisomerization" as used herein refers to the conversion of such a feed stream wherein the (a) type hydrocarbon is isomerized to the (b) type hydrocarbon in the presence of hydrogen and wherein diolefins are selectively hydrogenated to olefins. Preferred feed streams include those comprising mixtures of isobutene and butene-1, isopentene and pentene-1, and the like.

A typical cracked hydrocarbon feed composition found in refinery operations suitable for the process of this invention is a feed stream containing saturated hydrocarbons having from 3 to 6 carbon atoms per molecule, propylene, isobutylene, butadiene, butene-2 in both the cis and trans forms, butene-1 (the component desired to be isomerized to butene-2), amylene compounds and minor amounts of other diolefins. The cracked hydrocarbon stream can also contain sulfur compounds of organic or inorganic in type.

The catalysts utilized in the hydroisomerization subprocesses of this invention comprise the noble metals of Group VIII of the Periodic Table of Elements, as listed in the Handbook of Chemistry and Physics, published by the Chemical Rubber Company, in the 49th edition (1969), page B-3. The catalysts intended to be included in the group of noble metals of Group VIII specifically are ruthenium, rhodium, palladium, osmium, iridium, and platinum.

Any of the usual catalyst supports can be employed, such as alumina (preferred), silica alumina, glass beads, and carbon. Catalysts in the form of pellets, spheres, and extrudates are satisfactory.

A preferred hydroisomerization catalyst is palladium on a carrier, the carrier preferably being alumina. The catalyst should contain from about 0.005 to about 2.0 percent palladium on alumina, preferably about 0.1 to about 1.0 weight percent palladium on alumina. Most preferably, the catalyst should contain from about 0.3 to about 0.5 weight percent palladium on alumina. A suitable catalyst weighs about 40 to about 60 pounds per cubic foot, has a surface area of about 30 to about 150 square meters per gram, a pore volume of about 0.35 to about 0.50 ml. per gram, and a pore diameter of about 200 to about 500 Å.

As an example, a suitable commercial hydroisomerization catalyst satisfactory for use in this invention is manufactured by Mallinckrodt Specialty Chemicals Company, designated as Calsicat catalyst number E-144 SDU. The commercial catalyst contains about 0.55 weight percent palladium on alumina.

As understood in the art, the Group VIII metal support hydroisomerization catalyst can be regenerated when the activity of the catalyst declines with time due to carbonization of the feed material and deposition on the catalyst. The regeneration is conducted at elevated temperatures using the oxygen containing gas, e.g., air, $CO_2$ flue gases, and the like. The temperature of treatment is dependent upon the particular catalyst used; however, there is generally an upper temperature limit which should not be exceeded where the catalyst is severely degraded. For example, the treatment of a palladium on alumina catalyst should not exceed about 950° F.

The hydroisomerization subprocess is conducted at a reaction temperature of about 100° to about 300° F., preferably 130°-200° F.

The hydroisomerization subprocess of this invention can be most effectively practiced at relatively low pressure conditions while maintaining the hydrocarbon most preferably in the liquid phase, although vapor phase operation can be used. Pressures employed for the liquid phase process are from about 100 to about 600 psig, preferably from about 150 to about 300 psig. Liquid hourly space velocities, LHSV, are maintained from about 2 to about 50, preferably from about 3 to about 10.

Hydrogen is utilized in the hydroisomerization process by preferably being mixed with the hydrocarbon feed stream prior to contacting the stream with the hydroisomerization catalyst. The hydrogen is necessary to effect double bond isomerization of the 1-olefin with the hydroisomerization catalysts and to provide for hydrogenation of diolefins to olefins. The hydrogen is added in amounts from 0.1 to 20.0 mol percent, preferably in amounts of about 1.0 to about 10.0 mol percent.

The hydroisomerate streams produced by the hydroisomerization subprocesses of this invention are charged or passed to at least one etherification subprocess whereby the iso-olefins present in said streams are converted to ethers by reaction with primary or secondary alcohols in the presence of an acid ion exchange resin catalyst. Generally, the iso-olefins include those hydrocarbons having 4 to 16 carbon atoms per molecule. Examples of such iso-olefins include isobutylene, isoamylene, isohexylene, isoheptylene, isooctylene, isononylene, isodecylene, isoundecylene, isododecylene, isotridecylene, isotetradecylene, isopentadecylene, and isohexadecylene, or mixtures of two or more thereof.

The alcohols which may be utilized in the etherification subprocess include the primary and secondary aliphatic alcohols having from 1 to 12 carbon atoms, such as methanol, ethanol, propanol, isopropanol, the primary and secondary butanols, pentanols, hexanols, ethylene glycol, propylene glycol, butylene glycol, the polyglycols, and glycerol, etc., or mixtures of two or more thereof.

The presently preferred reactants of the etherification subprocess are methanol and isobutylene and/or an amylene because they respectively yield methyl tertiary butyl ether (MTBE) and tertiary amyl methyl ether (TAME) which have utility as octane improvers for gasoline. Accordingly, it is currently preferred for the iso-olefins to be predominately isobutylene and isoamylene compounds with the double bond on the tertiary carbon atom of said isoamylene compounds and the alcohol predominately methanol. Another preferred embodiment of this invention includes the use of the reactants ethanol and isobutylene to yield ethyl tertiary butyl ether (ETBE).

It is generally preferred for the iso-olefin and the alcohol to be passed through the etherification reaction zones in the presence of diluents which do not have an adverse effect upon the etherification reaction. The diluents can be present in either the first stream or the second stream, or both, preferably the diluent is in the iso-olefin stream. Examples of suitable diluents include alkanes and straight chain olefins. The feed to the reactors, excluding alcohol, is generally diluted so as to include about 2 to about 80 weight percent iso-olefin, preferably about 10 to about 60 weight percent.

The acid ion-exchange catalysts useful in the etherification subprocess of the present invention are relatively high molecular weight carbonaceous material containing at least one $SO_3H$ functional group. These catalysts are exemplified by the sulfonated coals ("Zeo-Karb H", "Nalcite X and "Nalcite AX") produced by the treatment of bituminous coals with sulfuric acid and commercially marketed as zeolitic water softeners or base exchangers. These materials are usually available in a neutralized form and in this case must be activated to the hydrogen form by treatment with a strong mineral acid such as hydrochloric acid and water washed to remove sodium and chloride ions prior to use. The sulfonated resin type catalysts are preferred for use in the present invention. These catalysts include the reaction products of phenolformaldehyde resins with sulfuric acid ("Amberlite IR-1", "Amberlite IR-100" and "Nalcite MX"). Also useful are the sulfonated resinous polymers of coumarone-indene with cyclopentadiene, sulfonated polymers of coumarone-indene with cyclopentadiene, and furfural and sulfonated polymers of cyclopentadiene with furfural. The most preferred cationic exchange resins are strongly acidic exchange resins consisting essentially of sulfonated polystyrene resin, for instance, a divinylbenzene cross-linked polystyrene matrix having from 0.5 to 20 percent and preferably from 4 to 16 percent of copolymerized divinylbenzene therein to which are ionizable or functional nuclear sulfonic acid groups. These resins are manufactured and sold commercially under various trade names such as "Dowex 50", "Nalcite HCR" and "Amberlyst 15". As commercially obtained they have solvent contents of about 50 percent and can be used as is or the solvent can be removed first. The resin particle size is not particularly critical and therefore is chosen in accordance with the manipulative advantages associated with any particular size. Generally mesh sizes of 10 to 50 U.S. Sieve Series are preferred. The reaction may be carried out in either a stirred slurry reactor or in a fixed bed continuous flow reactor. The catalyst concentration in a stirred slurry reactor should be sufficient to provide the desired catalytic effect. Generally catalyst concentration should be 0.5 to 50 percent (dry basis) by weight of the reactor contents with from 1 to 25 percent being the preferred range.

Acid ion exchange resins, such as Rohm & Haas Amberlyst 15 and Dow Chemical Dowex M-31, are currently the most preferred catalysts for the etherification.

The temperature for the etherification reaction zones and the space velocity for the feeds to the etherification reactor zones can be selected as desired depending upon the degree of conversion desired and the temperature at which oligomerization becomes a problem. Generally, the temperature of the reaction zones will be in the range of about 86° F. to about 248° F., preferably about 95° F. to about 176° F. Pressures are generally selected to ensure that the charges and the products remain in the liquid phase during the reaction. Typical pressures are in the range of about 30 to about 300 psig. Generally, the liquid hourly space velocity (LHSV) of feed in the reactors will be in the range of about 2 to about 50 $hr^{-1}$.

The molar ratio of alcohol in said first feedstream to iso-olefin in said second feedstream will generally be in the range of about 0.5/1 to about 4/1, preferably about 0.8/1 to 1.2/1, most preferably about 1/1.

The alkylation subprocess of this invention can be carried out in any system which comprises means for alkylating olefins by isoparaffins in the presence of an acid catalyst to produce an alkylate product. The alkylation reaction generally can be carried out with the hydrocarbon reactants in the liquid phase; however, the reactants need not normally be liquid phase hydrocarbons. The reaction conditions can vary in temperature from sub-zero temperatures to temperatures as high as a few hundred degrees Fahrenheit, and can be carried out at pressures varying from atmospheric to as high as 1,000 p.s.i., and higher. A variety of alkylation catalysts can be employed in the alkylation reaction, including well-known catalysts, such as sulfuric acid, hydrofluoric acid, phosphoric acid; metal halides, such as aluminum chloride, aluminum bromide, etc., and other liquid alkylation catalysts. While generally applicable to the alkylation of hydrocarbons, the present invention is particularly effective for the alkylation of low boiling olefins like ethylene, propylene, butenes, isobutylene, pentenes, etc., with saturated branched chain paraffins, such as isobutane, in the presence of hydrofluoric acid. In the alkylation of isoparaffins and olefins, a substantial molar excess of isoparaffin to olefin is employed, usually to provide a feed ratio in excess of 1:1, usually from about 4:1 to about 20:1 and preferably about 6:1 to 15:1. The reaction zone is maintained under sufficient pressure to ensure that the hydrocarbon reactants and alkylation catalysts are in the liquid phase. The temperature of the reaction will vary with the reactants and with the catalysts employed, but generally ranges from between about −40° F. to about 150° F.

Now referring to FIG. 1, there is provided a schematic representation of integrated olefin coprocessing system 10 of this invention. Paraffin hydrocarbons are introduced by way of line 12 into a dehydrogenation process system or steam active reforming (STAR) process system 14 whereby paraffin hydrocarbons are dehydrogenated and subsequently separated to produce a final dehydrogenate stream which leaves dehydrogenation process system 14 via line 16. Upon entering dehydrogenation process system 14, the paraffin hydrocarbon stream passes through a series of preheating equipment 18, such as, heat exchangers, which preheat and vaporize the paraffin hydrocarbon feed stream prior to it being mixed with steam and being charged to reactor furnace 20. The reactor effluent stream is conveyed from reactor furnace 20 to preheating equipment 18 via line 22, which is operably connected between reactor furnace 20 and preheating equipment 18. As the reactor effluent stream passes through preheating equipment 18, there is a transfer of heat energy from the reactor effluent stream to the paraffin hydrocarbon stream being conveyed to reactor furnace 20. A cooled reactor effluent stream passes by way of line 24, which is operably connected between preheating equipment 18 and steam generating equipment 26, whereby heat energy is transferred from the cooled reactor effluent stream to a makeup boiler feedwater and steam condensate mixture stream to produce steam. The makeup boiler feedwater is introduced into dehydrogenation process system 14 via line 28. The steam condensate passes by way of line 30 to be mixed with the makeup boiler feedwater passing through line 28 and subsequently introduced into steam generating equipment 26 via line 32. The resultant generated steam produced by steam generating equipment 26 passes by way of line 34 to compressor expander driver 36 whereby the steam is expanded in an essentially isentropic manner. The expanded steam will then pass by way of line 38 to be mixed with the incoming paraffin hydrocarbons prior to their entry into reactor furnace 20. The cooled reactor effluent will then pass through a series of cooling equipment 40 and to at least one phase separator 42 whereby a phase separation is performed to segregate the steam condensate, which passes by way of line 30 to line 32, and a hydrocarbon effluent stream. The hydrocarbon effluent stream passes by way of line 44 to compressor 46 whereby the hydrocarbon effluent is compressed and then discharged into line 48. The compressed hydrocarbon effluent stream passes by way of line 48 to a separation system 50 whereby there is a separation made between light hydrocarbons and hydrogen and a dehydrogenate stream comprising olefin compounds and paraffin hydrocarbons. The light ends and hydrogen, are conveyed from dehydrogenation process system 14 via line 52 and the dehydrogenate stream is conveyed from dehydrogenation process system 14 via line 16.

A cracked hydrocarbon stream comprising butylenes and amylenes are conveyed to fractionation system 54 via line 56. The cracked hydrocarbon stream is separated, utilizing fractionation system 54, into a $C_5$ olefin stream, which is conveyed from fractionation system 54 by line 58, and a $C_4$ olefin stream, which is conveyed from fractionation system 54 by line 62. Line 58 is operably connected between fractionation system 54 and first hydroisomerization system 64, and line 62 is operably connected between fractionation system 54 and second hydroisomerization system 66. The $C_5$ olefin stream is charged to a first hydroisomerization reactor 68, which defines a first hydroisomerization zone. Hydrogen is conveyed by way of line 70 and mixed with the $C_5$ olefin stream that is passing through line 58 prior to the resultant mixture entering first hydroisomerization reactor 68. The reactor effluent from first hydroisomerization reactor 68 passes by way of line 72 to a separation system 74 whereby a first hydroisomerate stream is separated from the reactor effluent and which passes from first hydroisomerization system 64 via line 76. Line 62 is operably connected between fractionation system 54 and second hydroisomerization system 66. The $C_4$ olefin stream is charged to a second hydroisomerization reactor 80, which defines a second hydroisomerization zone. Hydrogen is conveyed by way of line 70 and mixed with the $C_4$ olefin stream that is passing through line 62 prior to the resultant mixture entering second hydroisomerization reactor 80. The reactor effluent from second hydroisomerization reactor 80 passes by way of line 82 to a separation system 84 whereby a second hydroisomerate stream is separated from the reactor effluent and which passes from second hydroisomerization system 66 via line 86.

The first hydroisomerate stream, which passes from first hydroisomerization system 64 via line 76, and the second hydroisomerate stream, which passes from hydroisomerization system 66 via line 86, are mixed with methanol that is introduced via line 88 with the resultant mixture being introduced into first etherification system 90. The resultant mixture is charged to at least one etherification reactor 92 which define at least one etherification zone. Prior to the introduction of such mixture of isomerate streams and alcohol into at least one etherification reactor 92, an alcohol recycle stream is introduced into such charge mixture via line 94. The etherification reactor effluent passes by way of line 96 to ether fractionator 98 whereby an oxygenate stream is separated from unreacted feed compounds. The oxygenate stream is conveyed from etherification system 90 via line 100. The unreacted compounds pass by way of line 102 to alcohol extractor 104 whereby unreacted alcohol and unreacted hydrocarbon compounds are separated. The unreacted hydrocarbon compounds pass from alcohol extractor 104 via line 106 to alkylation system 108 and the unreacted alcohol passes to alcohol fractionator 110 via line 112. Alcohol fractionator 110 separates the unreacted alcohol and a solvent and recycles the unreacted alcohol to at least one etherification reactor 92 via line 94 and with the solvent being recycled to alcohol extractor 104 via line 114. The unreacted hydrocarbon compounds passing via line 106 are mixed with branched chain paraffin hydrocarbons passing by way of line 116 with the resultant mixture being introduced into alkylation system 108 by way of line 118. The resultant mixture is then introduced into alkylation reactor 120 which defines an alkylation zone and where, in the presence of an acid catalyst, the olefin compounds contained within the unreacted hydrocarbon compound stream are alkylated with the branched chain paraffin hydrocarbons to produce a reaction product comprising alkylate. The reactor effluent from alkylation reactor 120 passes to phase separator 122 wherein the hydrocarbons are separated from the acid catalyst. The separated hydrocarbon then passes by way of line 124 to separation system 126 whereby a propane stream, a butane stream, an alkylate stream, and a recycle isobutane stream are separated. The propane stream is conveyed from alkylation system 108 via line 128, the butane stream is conveyed from alkylation system 108 via line 130, the alkylate stream is conveyed from alkylation system 108 via line 132, and the recycle isobutane stream is conveyed from separation system 126 to alkylation reactor 120 via line 134.

Figure 2:
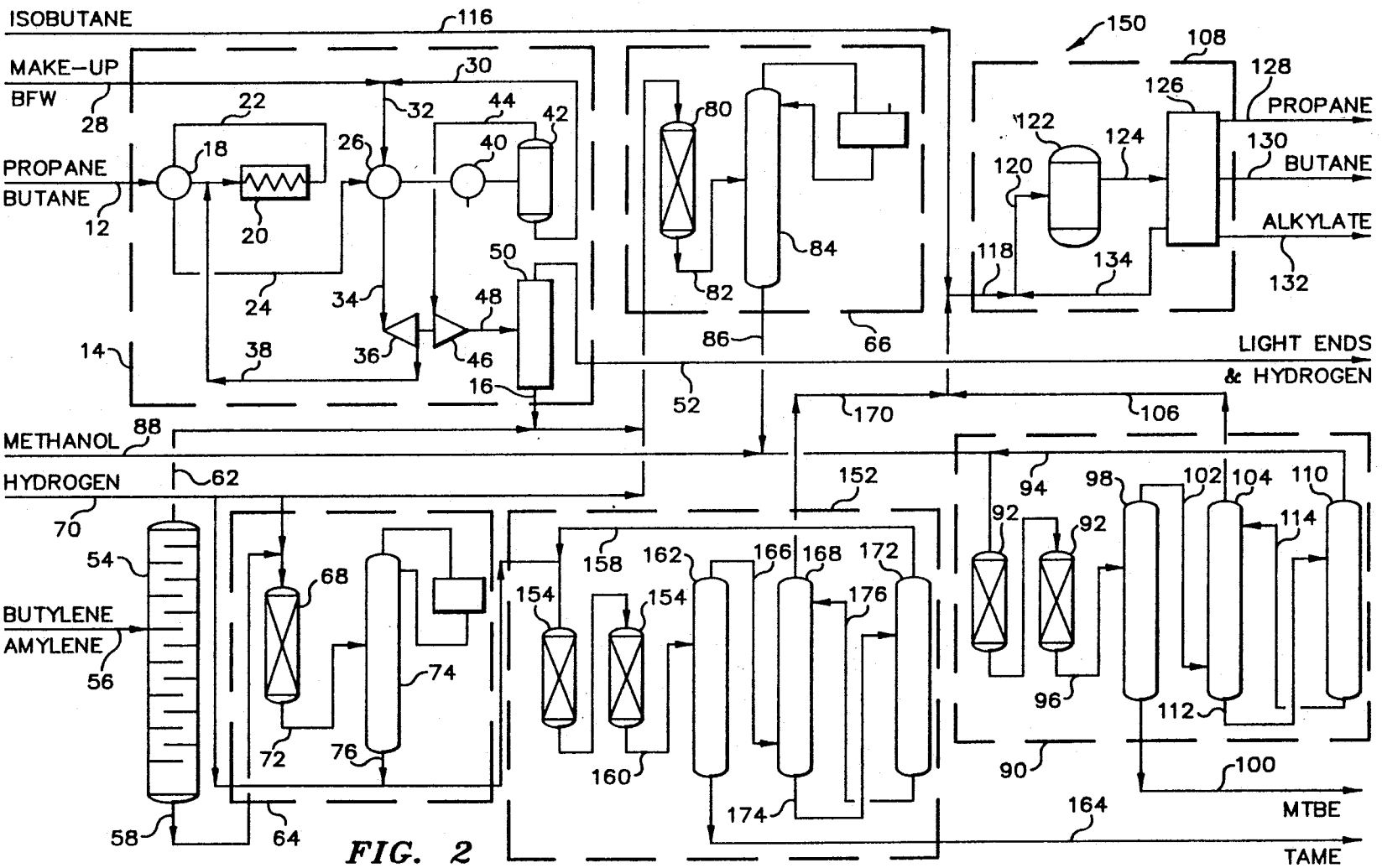
FIG. 2 is a schematic process flow diagram illustrating another preferred embodiment of the invention having parallel hydroisomerization processing and segregated etherification processing of olefins.

Now referring to FIG. 2, there is provided a schematic representation of segregated olefin processing system 150 which has all the same subprocessing systems as are provided with integrated olefin coprocessing system 10 as illustrated by FIG. 1 but having the additional subprocess system second etherification system 152. In segregated olefin processing system 150, the first hydroisomerate stream passes from first hydroisomerization system 64 via line 76 to second etherification system 152. Prior to the introduction of first hydroisomerate stream into at least one etherification reactor 154, the first hydroisomerate stream is mixed with methanol which is introduced via line 156 and the resultant mixture is introduced into second etherification system 152. The resultant mixture is then mixed with an alcohol recycle stream which is introduced into the mixture via line 158. The combined stream comprising the alcohol recycle stream, the methanol stream, and the first hydroisomerate stream is then introduced into at least one etherification reactor 154. The etherification reactor effluent passes by way of line 160 to ether fractionator 162 whereby an oxygenate stream is separated from unreacted feed compounds. The oxygenate stream is conveyed from etherification system 152 via line 164. The unreacted compounds pass by way of line 166 to alcohol extractor 168 whereby unreacted alcohol and unreacted hydrocarbon compounds are separated. The unreacted hydrocarbon compounds pass from alcohol extractor 168 via line 170 to alkylation system 108 and the unreacted alcohol passes to alcohol fractionator 172 via line 174. Alcohol fractionator 172 separates the unreacted alcohol and a solvent and recycles the unreacted alcohol to at least one etherification reactor 154 via line 158 and with the solvent being recycled to alcohol extractor 168 via line 176.

CALCULATED EXAMPLE

To illustrate the two processes shown in FIGS. 1 and 2, a calculated example is provided showing yields for a typical feedstock available from a 100,000 barrel per day (BPD) refinery. No attempt has been made to differentiate between results for Olefin Co-Processing, FIG. 1, and Segregated Processing, FIG. 2. The choice between the two alternative processes would be dictated by economics and equipment availability and is outside the realm of this calculated example. Table I shows the gasoline pool in volume (BPD) with Full Olefin Process by the present invention compared with the yield for Base Refinery gasoline by HF Alkylation of the $C_4$'s. The feed in both cases is a Post-FCC feedstock.

Octane and vapor pressure are significantly impacted by fully processing the olefins. By adding the amylenes to the processing pool, the consumption of butane is increased markedly. Overall, the butanes which have to be removed from the 8.0 RVP gasoline pool are reduced by over 90 percent, from 1,700 BPD in the base case, down to 170 BPD in the full olefin processing case. The gasoline pool octane is raised by over one number, and the volume of gasoline is increased by over 1,000 BPD. Considering reformulated gasoline production, the aromatics are close to the reformulated gasoline limit in this example, but benzene will pose a difficult problem. Addressing reformer cut points and operation may have the biggest impact on handling these properties in a reformulated gasoline blend. On the plus side for olefin processing, sufficient oxygen has been added to the gasoline pool to supply the requirements for selling nearly half the gasoline pool into the reformulated fuel market. A further advantage that will become increasingly important is that the environmentally detrimental amylenes are essentially removed from the finished gasoline sold to the consumer.

TABLE I

| Blendstock | Gasoline Pool With Olefin Processing Volume in Barrels Per Day (BPD) Post FCC Volume | Base Refinery Gasoline | Full Olefin Processing |
|---|---|---|---|
| Purch. Methanol | | — | 1,100 |
| Excess $nC_4$ | | | 170 |
| $iC_4$ | 2,000 | 0 | 0 |
| $nC_4$* | 2,000 | 300 | 986 |
| LSR** | 3,000 | 3,000 | 3,000 |
| Reformate | 16,000 | 16,000 | 16,000 |
| FCC $C_4$'s | 8,500 | 1,393 | 1,250 |
| Cat Gasoline | 27,500 | 27,500 | 25,420 |
| $C_4$ Aklylate | | 7,535 | 5,310 |
| $C_5$ Alkylate | | | 1,710 |
| MTBE | | | 1,590 |
| TAME | | | 1,585 |
| Total | 59,000 | 55,728 | 56,851 |
| RVP, psi | | 8.0 | 8.0 |
| (R + M)/2 | | 89.4 | 90.7 |
| Aromatics, Vol % | | 28.6 | 28.0 |
| Benzene, Vol % | | 2.40 | 2.35 |
| Oxygen, Wt % | | 0.0 | 0.94 |
| Olefins, Vol % | | 14.0 | 9.8 |

*$nC_4$ isomerized to meet $C_5$ Alkylation requirements
**Light Straight Run Gasoline Reasonable variations and modifications are possible within the scope of the foregoing disclosure, drawings and appended claims.

That which is claimed is:

1. A method for processing a paraffin hydrocarbon feedstock and a product of catalytic cracking of heavy hydrocarbons, said product of catalytic cracking of heavy hydrocarbons containing diolefin compounds, so as to produce alkylate and oxygenate gasoline blending components, comprising the steps of:

dehydrogenating said paraffin hydrocarbon feedstock to produce a dehydrogenate stream comprising olefin compounds and diolefin compounds;

separating said product of catalytic cracking of heavy hydrocarbons into a $C_4$ olefin stream and a $C_5$ olefin stream, said $C_4$ olefin stream comprising a significant portion of the hydrocarbons in said product of catalytic cracking of heavy hydrocarbons having less than five carbon atoms and said $C_5$ olefin stream comprising a significant portion of the hydrocarbons in said product of catalytic cracking of heavy hydrocarbons having at least five carbon atoms;

hydroisomerizing said $C_5$ olefin stream in a first hydroisomerization zone so as to hydrogenate diolefins to olefins and to produce a first hydroisomerate stream;

combining said dehydrogenate stream and said $C_4$ olefin stream to form a first combined stream;

hydroisomerizing said first combined stream in a second hydroisomerization zone so as to hydrogenate diolefins to olefins and to produce a second hydroisomerate stream;

combining said first hydroisomerate stream and said second hydroisomerate stream to form a second combined stream;

etherifying said second combined stream in an etherification zone to produce an oxygenate stream comprising oxygenate compounds and unreacted compounds;

alkylating a significant portion of said unreacted compounds by a branched chain paraffin hydrocarbon to produce an alkylate stream; and whereby said diolefin compounds are hydrogenated to olefins and alkylate and oxygenate gasoline blending components are produced.

2. A method for processing a paraffin hydrocarbon feedstock and a product of catalytic cracking of heavy hydrocarbons, said product of catalytic cracking of heavy hydrocarbons containing diolefin compounds, so as to produce alkylate and oxygenate gasoline blending components, comprising the steps of:

dehydrogenating said paraffin hydrocarbon feedstock to produce a dehydrogenate stream comprising olefin compounds and diolefin compounds;

separating said product of catalytic cracking of heavy hydrocarbons into a $C_4$ olefin stream and a $C_5$ olefin stream, said $C_4$ olefin stream comprising a significant portion of the hydrocarbons in said product of catalytic cracking of heavy hydrocarbons having less than five carbon atoms and said $C_5$ olefin stream comprising a significant portion of the hydrocarbons in said product of catalytic cracking of heavy hydrocarbons, having at least five carbon atoms;

hydroisomerizing said $C_5$ olefin stream in a first hydroisomerization zone so as to hydrogenate diolefins to olefins and to produce a first hydroisomerate stream;

combining said dehydrogenate stream and said $C_4$ olefin stream to form a combined stream;

hydroisomerizing said combined stream in a second hydroisomerization zone so as to hydrogenate diolefins to olefins and to produce a second hydroisomerate stream;

etherifying said first hydroisomerate stream in a first etherification zone to produce an oxygenate stream comprising oxygenate compounds and unreacted compounds;

etherifying said second hydroisomerate stream in a second etherification zone to produce an oxygenate stream comprising oxygenate compounds and unreacted compounds;

alkylating a significant portion of said unreacted compounds by a branched chain paraffin hydrocarbon to produce an alkylate stream; and whereby said diolefin compounds are hydrogenated to olefins and alkylate and oxygenate gasoline blending components are produced.

3. A process as recited in claim 1 wherein said paraffin hydrocarbon feedstock contains paraffin hydrocarbons having from 3 to 8 carbon atoms per molecule.

4. A process as recited in claim 3 wherein said dehydrogenate stream comprises olefin compounds having from 3 to 8 carbon atoms per molecule.

5. A process as recited in claim 4 wherein said dehydrogenate stream comprises diolefins, propylene and butylenes.

6. A process as recited in claim 5 wherein said paraffin hydrocarbon feedstock contains paraffin hydrocarbons selected from a group consisting of propane, butanes, pentanes and mixtures of any two or more thereof.

7. A process as recited in claim 6 wherein said product of catalytic cracking of heavy hydrocarbons comprises saturated hydrocarbons having from 3 to 6 carbon atoms per molecule, propylene, isobutylene, butadiene, butylenes, and amylenes.

8. A process as recited in claim 7 wherein said etherifying step utilizes methanol as a reactant to react with the isobutylene and/or amylene of said first hydroisomerate stream and said second hydroisomerate stream to produce said oxygenate stream respectively comprising methyl tertiary butyl ether (MTBE) and/or tertiary amyl methyl ether (TAME).

9. A process as recited in claim 7 wherein said etherifying step utilizes ethanol as a reactant to react with the isobutylene of said first hydroisomerate stream and of said second hydroisomerate stream to produce said oxygenate stream comprising ethyl tertiary butyl ether (ETBE).

10. A process as recited in claim 2 wherein said paraffin hydrocarbon feedstock contains paraffin hydrocarbons having from 3 to 8 carbon atoms per molecule.

11. A process as recited in claim 10 wherein said dehydrogenate stream comprises olefin compounds having from 3 to 8 carbon atoms per molecule.

12. A process as recited in claim 11 wherein said dehydrogenate stream comprises diolefins, propylene and butylenes.

13. A process as recited in claim 12 wherein said paraffin hydrocarbon feedstock contains paraffin hydrocarbons selected from a group consisting of propane, butanes, pentanes and mixtures of any two or more thereof.

14. A process as recited in claim 13 wherein said product of catalytic cracking of heavy hydrocarbons comprises saturated hydrocarbons having from 3 to 6 carbon atoms per molecule, propylene, isobutylene, butadiene, butylenes, and amylenes.

15. A process as recited in claim 14 wherein the step of etherifying said first hydroisomerate utilizes methanol as a reactant to react with the amylene of said first hydroisomerate stream to produce said oxygenate stream comprising tertiary amyl methyl ether (TAME).

16. A process as recited in claim 14 wherein the step of etherifying said second hydroisomerate stream utilizes methanol as a reactant to react with the isobutylene of said second hydroisomerate stream to produce said oxygenate stream comprising methyl tertiary butyl ether (MTBE).

17. A process as recited in claim 14 wherein the step of etherifying said second hydroisomerate stream utilizes ethanol as a reactant to react with the isobutylene of said second hydroisomerate stream to produce said oxygenate stream comprising ethyl tertiary butyl ether (ETBE).

* * * * *